United States Patent [19]

Kato et al.

[11] Patent Number: 5,033,443

[45] Date of Patent: Jul. 23, 1991

[54] PILOT INJECTION DEVICE FOR FUEL INJECTION PUMP

[75] Inventors: Akira Kato, Nagoya; Koji Nagata, Kariya; Zenji Kuwabara; Terutada Kojima, both of Nagoya; Takashi Yamaguchi, Obu; Takaaki Ohashi, Komaki; Masato Hattori, Obu; Noriyosi Toyoda, Anjo; Noriaki Kawai, Okazaki; Teruo Sato, Nagoya; Toshio Fujimura, Aichi; Tadashi Watanabe, Toyota; Mitsumasa Yamada, Mishima; Tadashi Fukuyama; Takeshi Sato, both of Susono, all of Japan

[73] Assignee: Nippondenso CO., Ltd., Kariya, Japan

[21] Appl. No.: 371,225

[22] Filed: Jun. 26, 1989

[30] Foreign Application Priority Data

| | | | |
|---|---|---|---|
| Jun. 27, 1988 | [JP] | Japan | 63-84599 |
| Jun. 27, 1988 | [JP] | Japan | 63-84600 |
| Jun. 29, 1988 | [JP] | Japan | 63-86218 |
| Jul. 4, 1988 | [JP] | Japan | 63-88929 |
| Jul. 4, 1988 | [JP] | Japan | 63-88930 |
| Jul. 5, 1988 | [JP] | Japan | 63-89755 |
| Jul. 5, 1988 | [JP] | Japan | 63-89756 |

[51] Int. Cl.[5] ..... F02M 37/04

[52] U.S. Cl. ..... 123/506; 123/300; 123/516

[58] Field of Search ..... 123/299, 300, 447, 506, 123/516

[56] References Cited

U.S. PATENT DOCUMENTS

| | | | |
|---|---|---|---|
| 3,456,629 | 7/1969 | Dangauthier . | |
| 4,469,069 | 9/1984 | Kuroyanagi et al. . | |
| 4,530,337 | 7/1985 | Gaufer | 123/300 |
| 4,625,694 | 12/1986 | Adey | 123/516 |
| 4,694,810 | 9/1987 | Miyamoto | 123/516 |
| 4,831,986 | 5/1989 | Linder | 123/300 |
| 4,831,991 | 5/1989 | Cayot | 123/516 |
| 4,840,155 | 6/1989 | Karle | 123/300 |

FOREIGN PATENT DOCUMENTS

| | | | |
|---|---|---|---|
| 0116168 | 8/1984 | European Pat. Off. . | |
| 3541049 | 6/1986 | Fed. Rep. of Germany . | |
| 2067883 | 8/1971 | France . | |
| 0112419 | 9/1979 | Japan | 123/516 |
| 2170557 | 8/1986 | United Kingdom . | |
| 2186920 | 8/1987 | United Kingdom . | |

OTHER PUBLICATIONS

Patent Abstracts of Japan, vol. 10, No. 291 (M-522)(2347) Oct. 3, 1986 & JP-A-61 106971 (Diesel Kiki) 24 May 1986.

Patent Abstracts of Japan, vol. 12, No. 227 (M-713)(3074) Jun. 28, 1988, & JP-A-63-21359 (Nippon Denso) 28 Jan. 1988.

*Primary Examiner*—Carl Stuart Miller

*Attorney, Agent, or Firm*—Cushman, Darby & Cushman

[57] ABSTRACT

A pilot injection device for a fuel injection pump has an accumulate piston movable in response to a fuel pressure from a pressurizing chamber of the fuel injection pump to cause a pilot injection prior to a main injection by the pump. The device is provided with a back-pressure chamber filled with fuel and having a volume variable by the movement of the accumulate piston. Air trapped in the back-pressure chamber can be removed therefrom through a hole to improve the operation characteristic of the pilot injection device.

13 Claims, 8 Drawing Sheets

PILOT INJECTION DEVICE FOR FUEL INJECTION PUMP

BACKGROUND OF THE INVENTION

1. Field of the Invention

The present invention relates to a pilot injection device for a fuel injection pump which is connected to a pressurizing chamber of the fuel injection pump and is capable of performing pilot injection prior to the main injection of fuel.

2. Description of the Prior Art

There are known pilot injection devices for fuel injection pumps which are designed to reduce combustion noise and to improve the ignition performance of Diesel engines. Such a pilot injection device for a fuel injection pump is arranged to cause a pilot injection to be performed prior to the main injection performed by the fuel injection pump, the main injection being then performed when the fuel supplied by the pilot injection has been burnt in the combustion chamber of a diesel engine.

"Pilot Injection Device For Fuel Injection Pump" (Japanese Patent Laid-Open No. 62-195662) is one example of the known technologies of this type. The device disclosed in this publication is arranged such that a stopper and a spring are provided, the stopper restricting the distance of movement of an accumulator piston which is movably inserted into a cylinder connected to the pressurizing chamber of a fuel injection pump, while the spring acts to urge, through a holding member, a rod arranged to move in synchronization with the accumulate piston. As a result, the stopper holds the rod, while the holding member is arranged to be secured to the rod. Consequently, noise, mechanical damage and fatigue of the spring due to the collision between the rod and the holding member are prevented.

The above-described type of conventional device includes a back-pressure chamber filled with fuel which is disposed next to the stopper on the side opposing the cylinder, and includes the holding member and the spring. Fuel which has been pressurized in the pressurizing chamber is introduced, via the rod portion of the stopper to which the rod is secured, into this back-pressure chamber through a gap between the accumulate piston and the cylinder where they are coupled to each other. On the other hand, this back-pressure chamber is connected to, for example, a low pressure portion of, for example, the fuel tank through of a return passage. Therefore, the fuel which has been introduced into the back-pressure chamber in synchronization with the movement of the accumulate piston flows out via the return passage to the low pressure portion so that the amount of fuel in the back-pressure chamber can be adjusted.

However, according to the above-described conventional device, the pressure in the back-pressure chamber can be changed if air is mixed with the fuel enclosed in the back- pressure chamber when the pilot injection device is assembled, fuel is changed, or the device is dismantled for maintenance purposes. The thus generated change in the pressure in the back-pressure chamber causes a problem that the movement of the accumulate piston within the cylinder controlled by the pressure in the back-pressure chamber becomes unstable.

Furthermore, another problem arises due to the above-described problem, that is, fuel injection characteristics most suited to the engine operating conditions cannot be obtained since the timing at which the fuel pressure in the pressurizing chamber is reduced by connecting the pressurizing chamber of the fuel injection pump and the cylinder is adversely changed every time the fuel is supplied by the fuel injection pump. That is, the above-described mixed air causes a reduction in the injected amount of fuel, and the rate of rise in the injecting pressure is changed. Therefore, a suitable pilot injection becomes impossible sometimes.

In order to remove the air mixed with the fuel filled in the back-pressure chamber, it might therefore be considered practical to employ a structure arranged such that the mixed air is discharged through the return passage by conducting a test operation of the fuel injection pump after assembly or maintenance work has been completed. However, adoption of this method means a lengthening of the time taken to discharge the mixed air, which leads to a lowering of the working efficiency. In addition, it is impossible to achieve complete removal of the mixed air and the reliability of the work is reduced.

SUMMARY OF THE INVENTION

An object of the present invention is to make it possible to quickly and reliably remove, with a simple operation air mixed with fuel in the back-pressure chamber.

In order to achieve this object, the pilot injection device for a fuel injection pump according to the present invention, comprises:

a member forming a cylinder connected to a pressurizing chamber of the fuel injection pump;

an accumulate piston movably disposed within the cylinder and capable of being moved by a pressure in accordance with rise in the fuel pressure in the pressuring chamber;

a member forming a back-pressure chamber which is connected to the cylinder, filled with fuel therein, and capable of controlling the movement of the accumulate piston; and means for taking out air accumulated in the back-pressure chamber.

DESCRIPTION OF THE PREFERRED EMBODIMENTS

Figure 2:
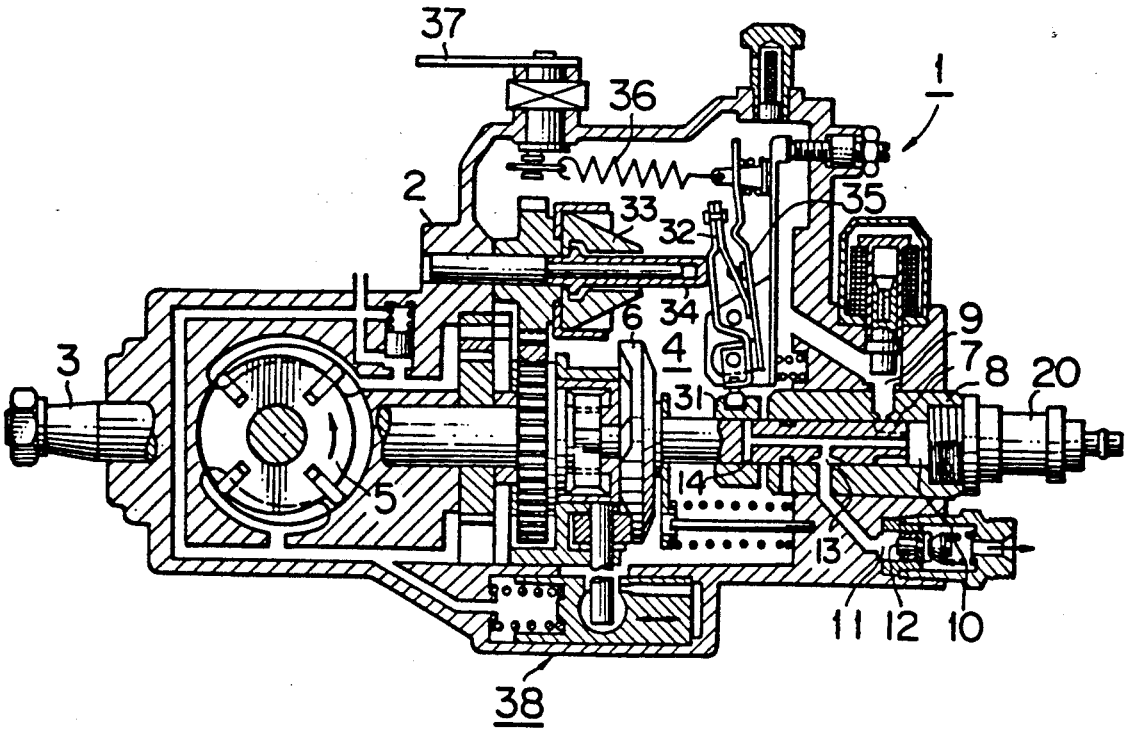
FIG. 2 is a sectional view which illustrates the overall structure of a fuel injection pump provided with the pilot injection device shown in FIG. 1.

A distribution type fuel injection pump 1 shown in FIG. 2 comprises a pump housing 2 which accommodates: a vane pump 5 arranged to be actuated by the rotation of a drive shaft 3 and capable of raising the pressure of fuel to supply it to a pump chamber 4; a cam plate 6 connected to the drive shaft 3 with a coupling (not shown); and a plunger 7 arranged to be rotated together with the cam plate 6 as well as to be reciprocated. The plunger 7 is so inserted into a pump cylinder 8 as to suck fuel from pump chamber 4 through an intake port 9 into a pressurizing chamber 10 due to its reciprocations. The fuel is thus pressurized in this pressuring chamber 10. The plunger 7 comprises a distribution port 13 which distributes the fuel pressurized in the pressurizing chamber 10 to distribution passages 11 at a predetermined timing so as to supply it under pressure to each of nozzles of a diesel engine (omitted from illustration) through a delivery valve 12, and a spill port 14 for sending the thus-pressurized fuel to the pump chamber in an overflow manner. A pilot injection device 20 communicating with the pressurizing chamber 10 is fixed to the pump cylinder 8 by means of screw threads.

A spill ring 31 is fitted onto the plunger 7 at the position of the spill port 14. This position of the spill ring 31 determines the time at which the pressurization of the fuel by means of the plunger 7 is completed, that is, the amount of fuel to be injected is determined. The spill ring 31 is connected by a supporting lever 32 to a governor sleeve 34 which is moved in response to the action of flyweights 33, while the ring 31 is also connected, via a tension lever 35 and a governor spring 36, to a control lever 37 which is arranged to be moved in synchronization with an accel pedal. As a result, the spill ring 31 moves in correspondence with the car speed and the degree of operation of the accelerator. A timer mechanism 38 controls the fuel injection timing in accordance with the fuel pressure in the pump chamber 4. In FIG. 2, only the vane pump 5 and the timer mechanism 38 are illustrated in the form of a 90° development.

The thus structured pilot injection device 20 temporally reduces the pressure of the fuel in the pressure chamber 10 during a forward stroke (fuel sending stroke) of the plunger 7 to interrupt the fuel supply under pressure and executes a main injection after performing a pilot injection of fuel.

Figure 1:
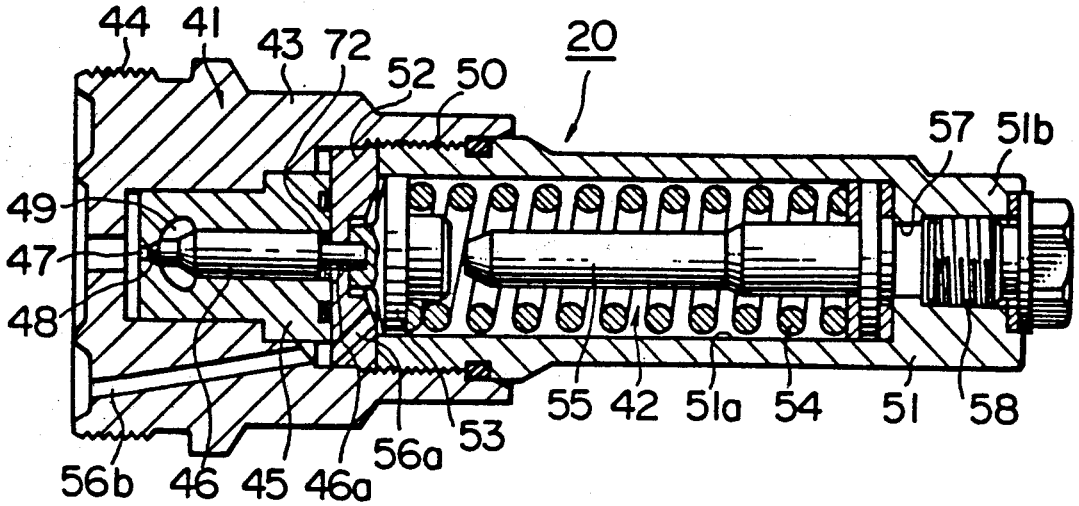
FIG. 1 is a sectional view which illustrates an embodiment of the present invention.

Then, the structure of the pilot injection device 20 will be described with reference to FIG. 1. The pilot injection device 20 comprises an operating portion 41 communicating with the pressure chamber 10 of the fuel injection pump 1 and a back pressure chamber 42 for controlling the operation of the operating portion 41.

The operating portion 41 is fastened horizontally to the fuel injection pump 1 by means of a thread portion 44 formed in a housing 43. The housing 43 accommodates a cylinder 45 in which an accumulate piston 46 is inserted. Furthermore, this cylinder 45 has an oil reservoir 49 connected to the pressurizing chamber 10 of the fuel injection pump 1 via a small opening 47 and arranged to be closed by a seat portion 48 formed at the front portion of the accumulate piston 46.

The back-pressure chamber 42 is formed by a cap 51 having a threaded portion 50 formed in the outer surface of the front portion thereof and defining a back-pressure chamber hollow-space 51*a* therein. This cap 51 is secured to the housing 34 by means of the threaded portion 50. A stopper 52 is disposed between the housing 43 and the cap 51, this stopper 52 restricting the movement of the accumulate piston 46 towards the back-pressure chamber 42. The stopper 52 closes the back-pressure chamber hollow-space 51*a* at the end thereof adjacent to the cylinder 45.

A pressure pin 53 which is connected to the accumulate piston 46 is disposed within the back-pressure chamber hollow-space 51*a*. The space 51*a* receives therein a spring 54 for urging the pressure pin 53 towards the pressuring chamber 10. Any excessive movement of the pressure pin 53 which is arranged to move in synchronization with the accumulate piston 46 is restricted by an stopper pin 55. In addition, the back-pressure chamber hollow-space 51*a* and the fuel injection pump 1 are connected to each other by return passages 56*a* and 56*b* formed respectively in the stopper 52 and the housing 43 and by another return passage (not shown) formed in the pump cylinder 8. Therefore, the fuel allowed to flow due to the overflow from the back-pressure chamber 42 returns through the return passages 56*a* and 56*b* to the pump chamber 4 which serves as the low-pressure portion of the fuel injection pump 1.

On the other hand, a through-hole 57 which establishes a connection between the back-pressure chamber hollow-space 51*a* and the outside portion of the back-pressure chamber 42 is formed in an end portion 51*b* of the cap 51. A screw 58 is inserted into the end portion of the cap 51 which is remote from connection of the through-hole to the back-pressure chamber hollow-space 51*a*. When this screw 58 is inserted into the through-hole 57, the through-hole 57 and the back-pressure chamber 42 are insulated from outside. On the other hand, when the screw 58 is removed from the through-hole 57, the through-hole 57 and the back-pressure chamber 42 are connected to the outside.

Figure 3:
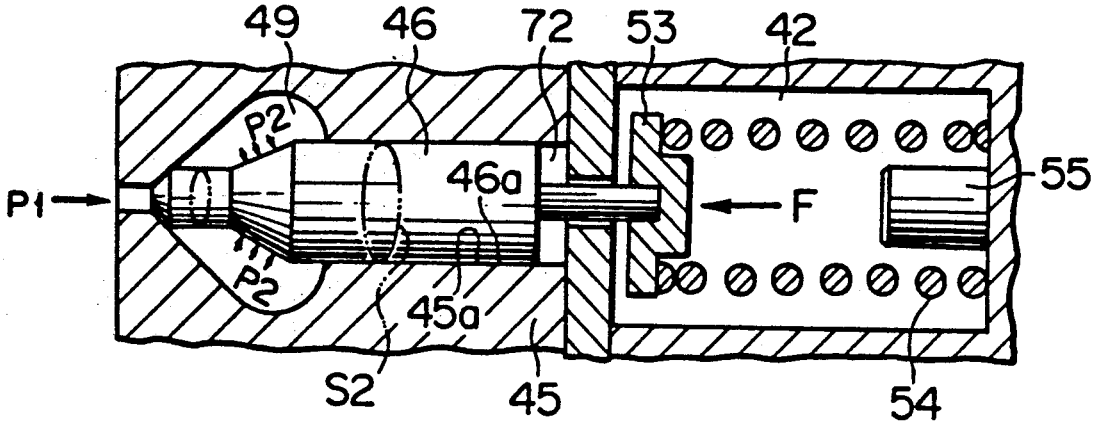
FIG. 3 is a schematic view which illustrates the details of the pilot injection device shown in FIG. 1.

A force acting on the accumulate piston 46 of the pilot injection device 20 at the moment when this accumulate piston 46 opens can be expressed by the Equation (1) below assuming, as shown in FIG. 3, that a kinetic valve-opening pressure (a pressure in the plunger chamber when the valve is opened) is P1, residual pressure in the oil reservoir 49 is P2, cross-sectional area of the head of the accumulate piston 46 (initial pressure receiving area) is S1, cross-sectional area at the major diameter portion of the accumulate piston 46 is S2, and specified urging force of the return spring 54 is F:

$$P1 \times S1 + P2 \times (S2 - S1) - F = 0 \quad (1)$$

Modifying Equation (1) and calculating the kinetic valve opening pressure P1 give the following Equation (2):

$$P1 = F/S1 - P2 \times (S2/i\ S1 - 1) \quad (2)$$

As is shown, the more the residual pressure Pa in the oil reservoir 49 rises, the lower the kinetic valve opening pressure P1 of the accumulate piston 46 becomes. Therefore, in order to maintain the kinetic valve opening pressure P1 above a predetermined level, the fuel retained in the oil reservoir 49 is caused to flow to a low pressure chamber 72 and the back-pressure chamber 42 through a gap formed between a sliding surface 46*a* of the accumulator piston 46 and a sliding surface 45*a* of the cylinder 45 for the purpose of reducing the residual pressure in the oil reservoir 49.

Figure 4:
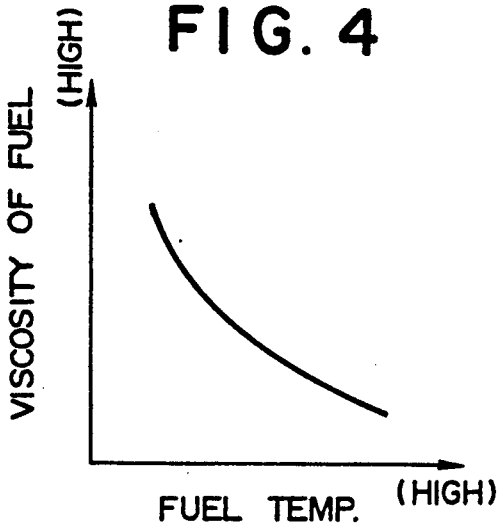
FIG. 4 is a characteristics curve which illustrates the relationship between the fuel temperature and the fuel viscosity.
Figure 13:
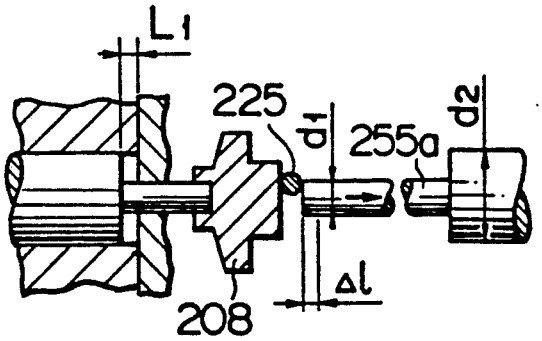
FIG. 13 illustrates the operation of the embodiment shown in FIG. 12.

On the other hand, as shown in FIG. 4, the viscosity of the fuel is raised with the reduction in the fuel temperature (the engine temperature). In particular, the flow of the fuel out of the oil reservoir 49 becomes difficult when the fuel is at a low temperature. According to the present invention, therefore, the clearance between the sliding surface 46*a* of the accumulating piston 46 and the sliding surface 45*a* of the cylinder 45 is therefore enlarged with respect to that provided in the conventional device.

Then, the size of this clearance will be described in comparison with a clearance between a nozzle needle and a nozzle body of an injection nozzle of a diesel engine having a structure similar to that of the pilot injection device 20.

Figure 5:
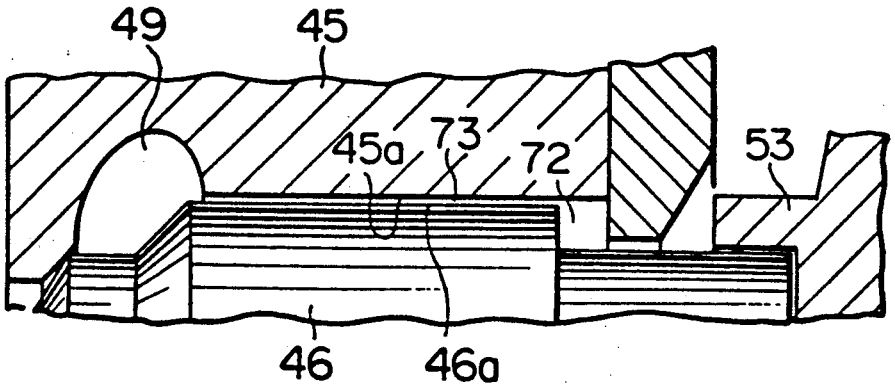
FIG. 5 is an enlarged view of a part of FIG. 5.
Figure 6:
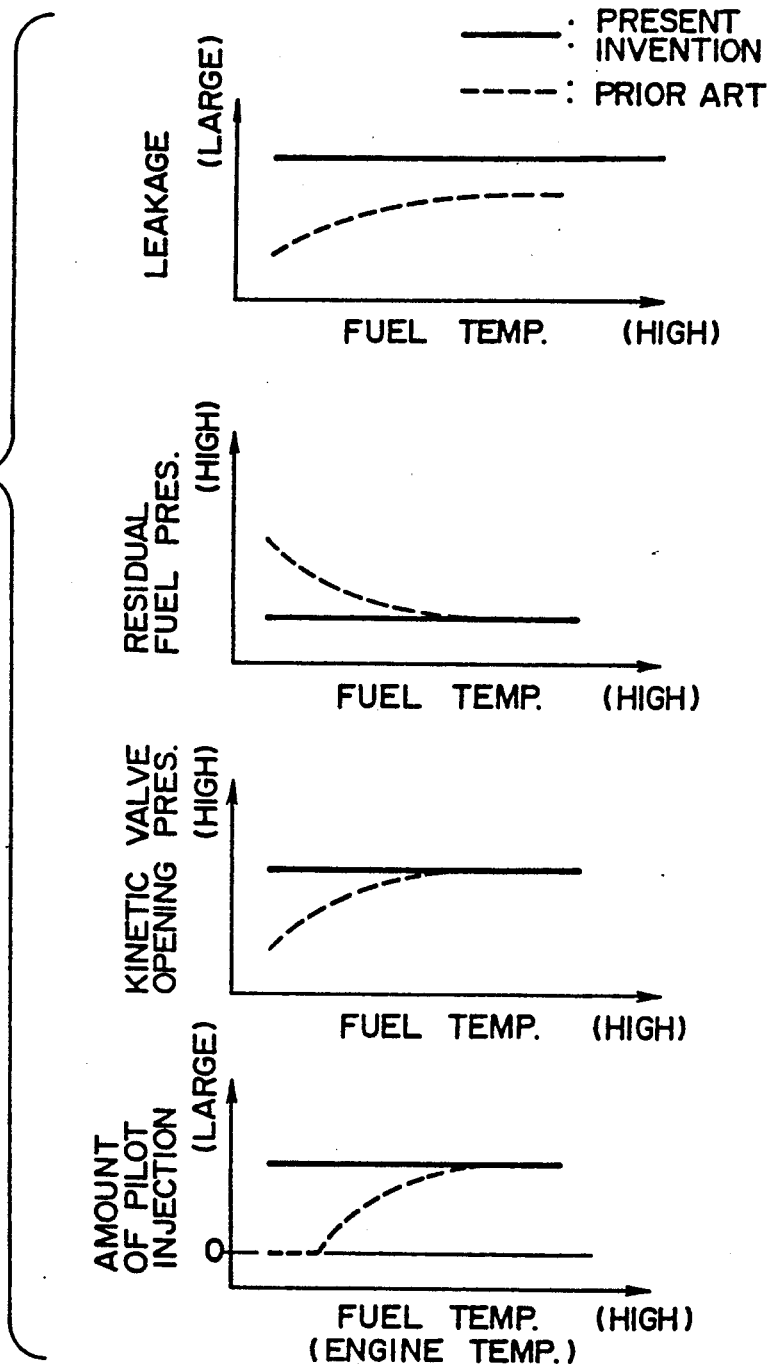
FIG. 6 illustrates fuel characteristics.
Figure 7:
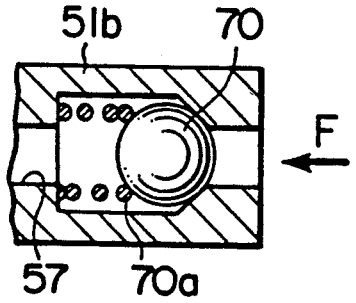
FIG. 7 is a view which illustrates a modification to the embodiment shown in FIG. 1.

An amount of air leak through the clearance of the injection nozzle is 1 to 10 cc/min. when the air pressure is 2.5 atm. The above-described clearance is determined in a range with which the lubrication mainly by the fuel can be effected and overheating of the nozzle needle due to lacking of lubrication and generation of a rough surface in movable portion can be prevented. However, as shown in FIG. 5, the clearance 73 between the sliding surface 46*a* of the accumulate piston 46 and the sliding surface 45*a* of the cylinder 45 is enlarged to the extent at which the amount of air leakage through the clearance 73 is 75 to 150 cc/min. when the air pressure is 2.5 atm. The above-described range of the clearance is determined on the basis of the type of the fuel and the characteristics specified for the engine, preferable range (at which stable amount of fuel injection can be always obtained without any fear of the rise in the residual pressure) being 90 to 120 cc/min. As a result, the fuel which has been remained in the oil reservoir 49 can be always and positively allowed to flow by a sufficient quantity to the low pressure chamber 72 and the back-pressure chamber 42 through the clearance 73. Furthermore, since the clearance 73 is provided all around, any damage due to abrasion cannot be generated between the two sliding surfaces 46*a* and 45*a* of the accumulate piston 46 and the cylinder 45. Therefore, even if the temperature of the fuel were low, the residual pressure P2 in the oil reservoir can be reduced. As a result, the kinetic valve opening pressure of the accumulate piston 46 can be always maintained at a predetermined level even if the viscosity of fuel were raised due to lowering of the atmospheric temperature, for example, the lowering of the temperature of the fuel (engine temperature). The size of the clearance 73 can be determined by a calculation formula in which the conditions of the boundary which corresponds to the specifications of the device are so used as to make the fuel flow through the clearance 73 to be a predetermined level (for example, a fuel flow at high temperature) even if the viscosity of the fuel is increased due to the lowering of the temperature of the fuel. The above-described formula can be used on the basis of a fact that, for example, a flow of viscous fluid passing through parallel walls can be expressed by a sum of a linear distribution and a paraboloid distribution in accordance with the conditions of the boundary. Therefore, as designated by a solid line shown in FIG. 6, the amount of leakage between the relatively movable portions between which the clearance 73 is formed can be maintained substantially at a predetermined level even if the temperature of the fuel (engine temperature) were lowered and the viscosity of the fuel were thereby raised. As a result, the residual fuel pressure in the oil reservoir 49 can be maintained at a relatively low predetermined level regardless of the temperature of the fuel.

Then, an operation for removing air from the pilot injection device 20 having the structure described above will be described. In general, when the pilot injection device 20 is mounted on the fuel injection pump 1, when fuel is changed, and when the maintenance and/or dismantling is conducted, air tends to be trapped in the back-pressure chamber 42. Therefore, the screw 58 is removed from the through hole 58 to expose the back-pressure chamber hollow-space 51*a* to the atmosphere. In this state, the fuel injection pump 1 is operated for testing for a predetermined time period. Then, fuel flows into the back-pressure chamber 2 from the pressurizing chamber 10 though the gap between the cylinder 45 and the accumulate piston 46 and a clearance formed between the smaller-diameter portion 46*a* of the accumulate piston 46 and an opening in the stopper 52. The air in the back-pressure chamber 42 and the introduced fuel are then discharged from the back-pressure chamber 42 through the through-hole 57. As described above, the test operation is conducted for a predetermined time period which has been determined upon results of experiments. As a result, the air trapped in the back-pressure chamber 42 can be quickly and perfectly discharged with the fuel through the through-hole 58. Therefore, when the screw 58 is driven into the through-hole 57 to thereby block the back-pressure chamber hollow-space 51*a* from the outside after a predetermined time has been elapsed, the back-pressure chamber 42 is filled with the fuel which does not contain any air. The determination as to whether or not the trapped air has been completely removed may be conducted on the basis of a fact that the injection characteristics of the fuel injection pump 1 has been stabilized.

As described above, and according to this embodiment, air which has been trapped in the back-pressure chamber 42 can be surely removed by a simple operation in a significantly sort time. Therefore, the reliability of the air removal from the back-pressure chamber 42 can be improved and the operation efficiency can also be improved. In addition, since no air is included in the fuel enclosed in the back-pressure chamber 42, the pressure in the back-pressure chamber can be kept in a stable state. Thus, the movement of the accumulate piston 46 can be conducted smoothly, so that the pilot injection and the ensuing main injection can be accurately conducted to provide stable injection characteristics.

Figure 8:
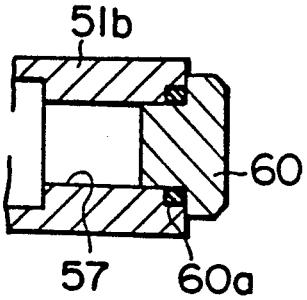
FIG. 8 is a view which illustrates another modification to the embodiment shown in FIG. 1.

Although the through hole 57 is designed to be opened/closed by the insertion/removal of the screw 58 according to this embodiment, a modified structure may be employed that includes a closure member 60 which is detachably inserted with a sealing member 60a into the through-hole 57 in an end portion 51b of the cap 51, as shown in FIG. 8. When this structure is employed, the closure member 60 can be detached without any special tool. As a result, the working efficiency can be further improved.

In addition, another modified structure may be employed which employs a valve which is normally closed and comprises a spherical valve 70 and a coil spring 70a urging this valve 70. The normally closed valve is provided within the through-hole 57 formed in an end portion 51b of the cap 51, whereby only when an external force is applied in the direction designated by an arrow F to the valve 70, the through-hole 57 is opened. In this case, since the normally closed valve is inserted in the through-hole 57, this through-hole 57 can be protected from becoming inoperative even if any erroneous operation is conducted, as a result of which the air-removing operation can be readily completed.

Figure 9:
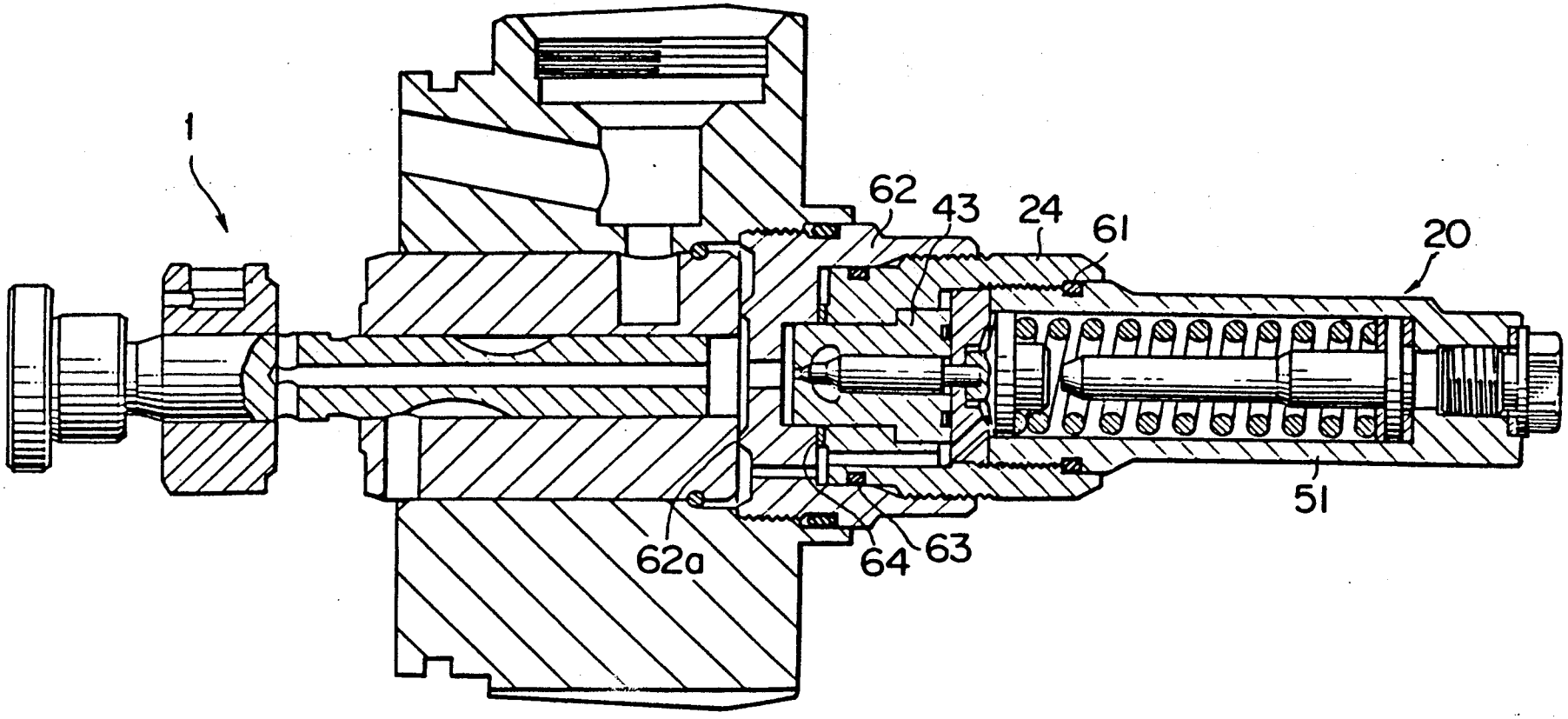
FIG. 9 is a view which illustrates a modified example for mounting the pilot injection device.

FIG. 9 is a view which illustrates an example of mounting of the pilot injection device according to the present invention on a fuel injection pump.

Referring to FIG. 9, the cap 51 is mounted on the inner surface of the housing 43 by screw threads and is sealed thereto by "0" ring 61. The left end portion of the housing 43 is screwed into a high pressure resisting sealing member 62. The housing 43 is sealed to the high pressure resisting sealing member 62 at both the outer peripheral surface and the inner end face thereof by means of the "0" ring 63 and a gasket 64.

The thus structured pilot injection device 20 can be attached and detached with the housing 43 to and from the high pressure resisting sealing member 62. Since the high pressure resisting sealing member 62 is secured to the fuel injection pump 1, this high pressure resisting sealing member 62 dose not move even if attaching-/detaching of the pilot injection device 20 is conducted repeatedly for the purpose of measuring a set timing or performing an overhauling. Therefore, the sealing performance realized by the high pressure resisting sealing member 62 with respect to the sealed portion 62a due to metal-to-engagement can be assured to prevent any fuel leakage.

Since the high pressure resisting member 62 and the pilot injection device 20 are sealed by the "0" ring 63 and the gasket 64, the desired sealing performance can be assured by way of replacing the "0" ring 63 and the gasket 64 when the device is re-assembled. This re-assembling work can be readily conducted since any adjustment required to assure the sealing performance is unnecessary. Therefore, this work can be readily completed.

Figure 10:
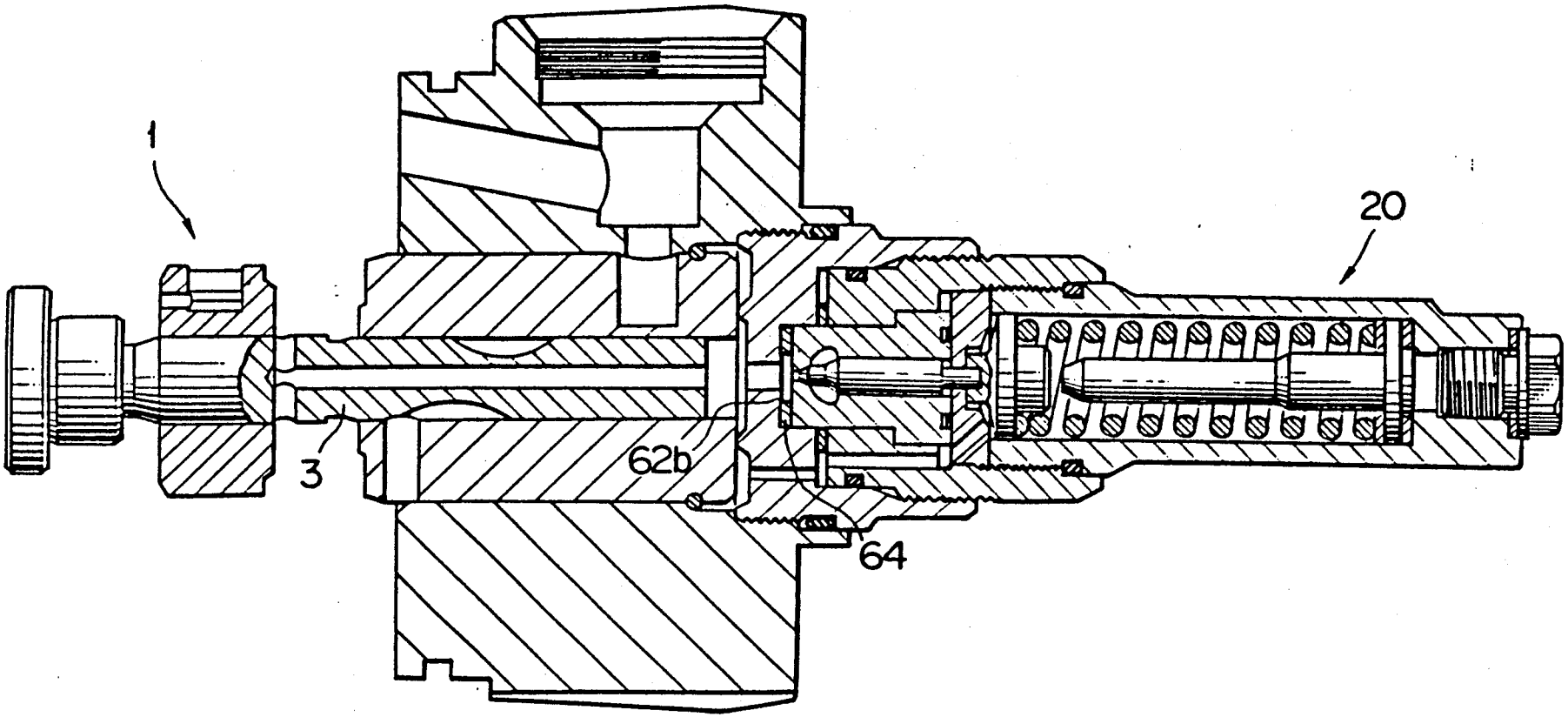
FIG. 10 is a view which illustrates another example for mounting the pilot injection device.

Alternatively, the gasket 64 may, as shown in FIG. 10, be positioned between the inner end face of the cylinder 45 and the end wall 62b of the high pressure resisting sealing member 62.

Another embodiment will be described with reference to FIG. 11.

Figure 11:
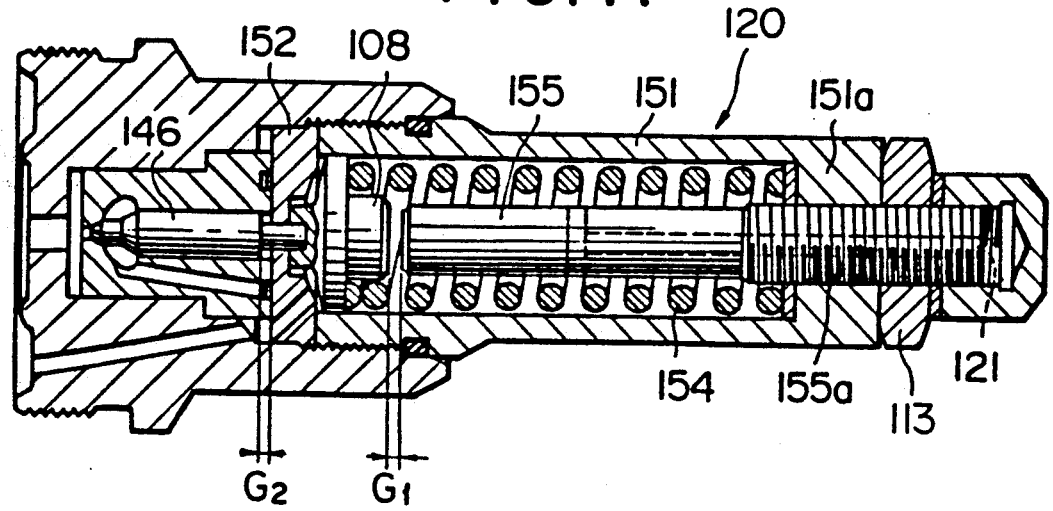
FIG. 11 is a sectional view which illustrates another embodiment of the present invention.

Referring to FIG. 11, a rod-like stopper 155 is inserted coaxially with a cap 151 into a spring 154 disposed in the cap 151. The rear half portion (right half portion in FIG. 11) of this stopper 155 is formed into a threaded portion 155a which is screwed into an end wall 151a of the cap 151. This threaded portion 155a project outwardly from the end wall 151a so that it is secured to the end wall 151a by a lock-nut 113. Reference numeral 120 represents a blind cap which is screwed onto the stopper 155. Reference numeral 121 represents a air outlet passage formed in the stopper 155.

The stopper 155 is secured by clamping the lock-nut 113 after a gap $G_1$ between a pressure pin 108 and the stopper 155 has been made the same as a gap $G_2$ between an accumulate piston 146 and the stopper 152, that is, after the amount of movements $G_2$ and $G_1$ of an accumulate piston 146 and the pressure pin 108 have been made the same and a condition of $G_1 > G_2$ is established with the cap 120 removed and the lock-nut 113 loosened. Since the movement of a washer 110 for adjusting the valve opening pressure can be prevented when the stopper 155 is rotated, the elasticity of the spring 154, that is, the valve opening pressure required for the accumulate piston 146, does not change. In addition, since the amount of movement of the pressure piston 108 is restricted to a small distance, any excessive distortion of the spring 106 can be prevented.

Then, a further embodiment will be described with reference to FIG. 12.

Figure 12:
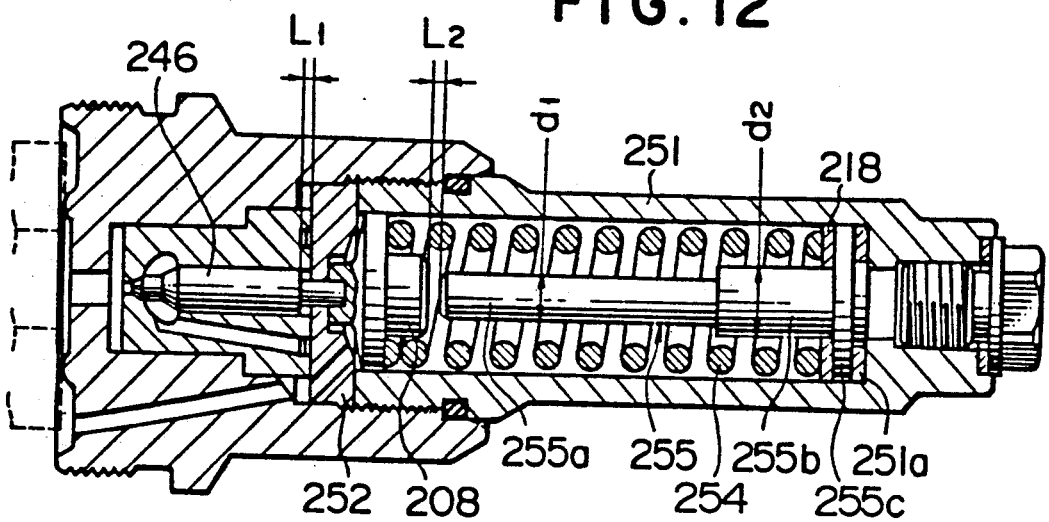
FIG. 12 is a view which illustrates a further embodiment of the present invention.

Referring to FIG. 12, a stopper 255 is disposed within a spring 254. The stopper 255 comprises a longer shaft portion 255a having a minor diameter $d_1$, a shorter shaft portion 255b having a major diameter $d_2$, and a flange-shaped spring seat 255C. The spring seat 255C is disposed in such a manner that a gap $L_2$ is provided between the front surface of a cap 251 and the rear end surface of a pressure pin 208 with a washer 223 disposed between the cap and the spring seat 255C. This gap $L_2$ is arranged to be slightly larger than a gap (the rearward movement of an accumulator piston 201) $L_1$ between a major diameter portion 201a of the accumulate piston 201 and a stopper 252.

As a result, the rearward movement of the pressure pin 208 due to an inertia force when the piston 201 receives a high hydraulic pressure through a connection hole 206 at its front end and thereby it moves rearward by $L_1$ is limited to $L_2 - L_1$. Therefore, the deflection of the spring 254 can be reduced with respect to a case where no stopper 255 is provide. Therefore, the weakening of the spring 254 can be prevented. In addition, if a foreign matter were present in the portion at which the pressure pin 208 comes contact with the stopper 255, the longer shaft portion 255a of the stopper 255 can be, as shown in FIG. 12, elastically deformed (amount of deformation $\Delta 1$) to a satisfactorily extent in its axial direction as viewed in FIG. 9, that is, the foreign matter can be moved in the axial direction of the stopper 155 when the pressure of the pressure pin 208 is received by the stopper 255. The reason for this lies in that the diameter $d_1$ of the longer shaft portion 255a of the stopper 255 is smaller than the diameter $d_2$ of the shorter shaft portion 255b and the longer shaft portion 255a is satisfactorily long. Therefore, a reaction to be received by the pressure pin 208 can be reduced, so that the pressure pin 208 can be protected from being inclined. Therefore, the lateral pressure involved to be received by the piston 201 can be reduced, and thereby the same can work normally.

According to this embodiment, the greater effect of preventing inclination of the pressure pin 208 can be obtained the more the length of the longer shaft portion 255a of the stopper 255 is since the amount of the elastic deformation $\Delta 1$ becomes larger. Therefore, the longer shaft portion 255a may be lengthened to an extent at which no buckling of the stopper 255 is generated.

Figure 14:
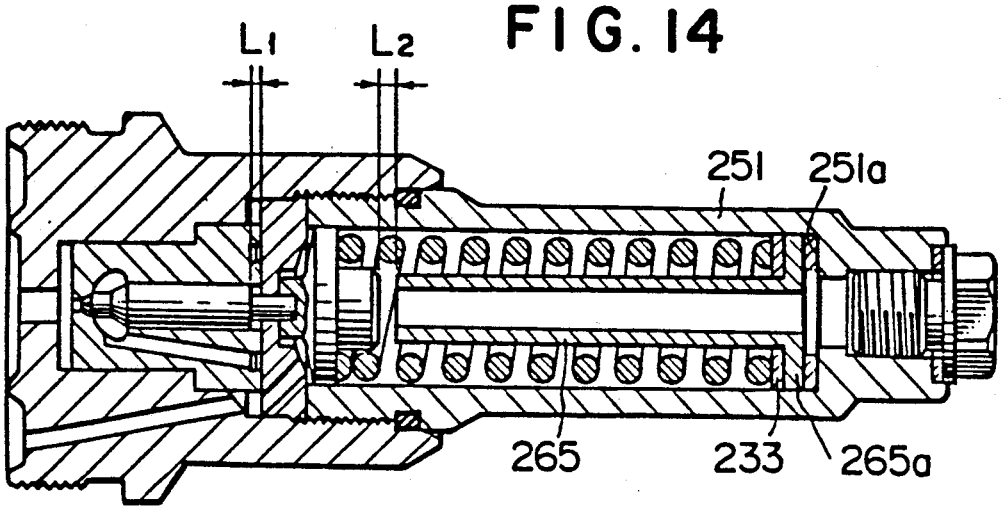
FIG. 14 is a sectional view which illustrates a modification to the embodiment shown in FIG. 12.

Alternatively, a structure shown in FIG. 14 may be employed which is arranged such that a stopper 265 is formed by a pipe and has its rear end portion (right end as viewed in this drawing) formed in a flange shape to support the spring 254 with a washer interposed therebetween and to be supported by an inner end 251*a* of the cap 251 with a washer 223 interposed therebetween.

According to this structure, although the cross-sectional area of the stopper 265 is small since it is formed in a pipe shape, its cross sectional area has a relatively large secondary moment. Therefore, even if any foreign matter were present between the stopper 265 and the pressure pin 208, the above-described elastic deformation Δl can be given to a considerably large extent without involving any buckling. Therefore, the reaction to be received by the pressure pin 208 can be reduced, and its inclination can thereby be reduced. As a result, the lateral pressure to be received by the piston 1 can be reduced, causing it to work normally. Furthermore, according to this structure, since a foreign matter can be dropped into the stopper 265, the pressure pin 208 is able to act regardless of the presence of the foreign matter.

In the embodiment shown in FIGS. 12 and 14, in order to enable the elastic deformation Δl of the stoppers 255 and 265 to be increased, it is preferable that the stoppers 255 and 265 are made of a material having a reduced Young's modulus. For this purpose, aluminum alloy is more preferable to be used than iron. In particular, in the embodiment shown in FIG. 14, even if a material having a reduced Young's modulus were employed, any fear of buckling does not rise.

Furthermore, a structure may be employed which is arranged such that a stopper 275 is formed in a rod shape having no step thereon and a recessed portion in the form of a mesh is formed in the front surface of the stopper 275 which contacts the pressure pin 208. According to this structure, even if any foreign matter were present between the recessed portion and the pressure pin 208 which are positioned in contact with each other, this foreign matter is caused to be dropped in the recessed portion, that is, the foreign matter is moved in the axial direction of the stopper 275. Therefore, any excessive force does not act on the pressure pin 208, so that the pressure pin is prevented from being inclined, and any lateral force does not act to the piston 201. The above-described recessed portion may alternatively be disposed in the surface of the pressure pin 208 which is positioned in contact with the stopper 275.

A still further embodiment will be described with reference to FIG. 15.

Figure 15:
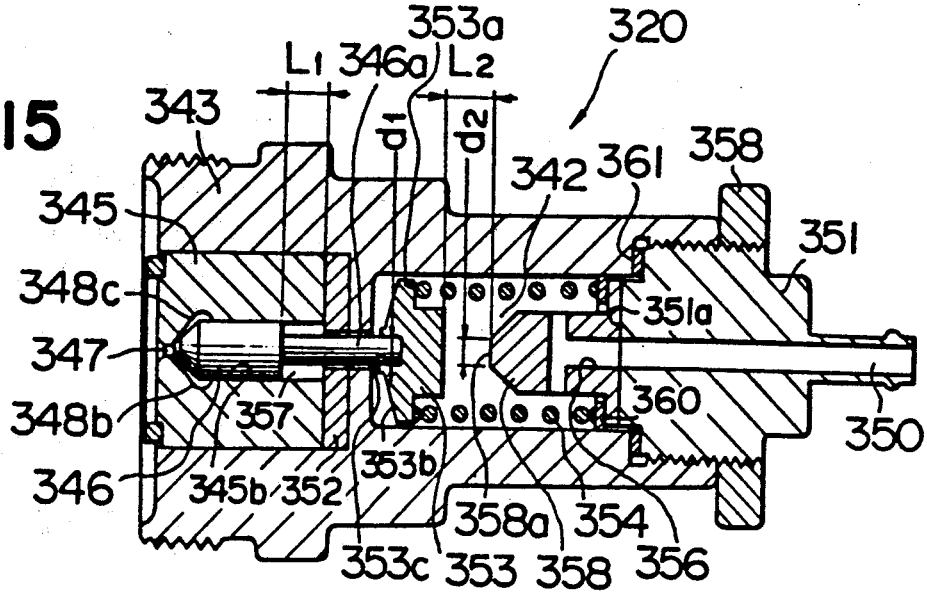
FIG. 15 is a sectional view which illustrates a still further embodiment of the present invention.

Referring to FIG. 15, a pilot injection device 320 includes, in a portion opposite to the pressurizing chamber with respect to a stopper 352, a spring 354 for urging an accumulate piston 346 toward the pressuring chamber, and a pressure pin 353 interposed between the accumulate piston 346 and the spring 354. The pressure pin 353 has a body portion 353*a* to which an end portion of the spring 354 is seated and a integral head portion 353*b* having a diameter larger than the outer diameter of the body portion 353*a* and having a tapered end surface. A bearing portion 353*c* into which a minor diameter portion 346*a* of a diameter $d_1$ on the rear portion of the accumulate piston 346 can be fitted with a certain play is formed in the head portion 353*b*. A first back-pressure chamber 357 filled with fuel is formed between the accumulate piston 346 and the pressure pin 353, while a second back-pressure chamber 342 filled with fuel is formed behind the pressure pin 347. The movable distance of the accumulate piston 346 which can be moved within a cylinder 345 of the first back-pressure chamber 357 is limited to a distance $L_1$ by the stopper 352. The fuel leaked out of the pressurizing chamber 10 of the fuel injection pump 1 through the gap between the accumulate piston 346 and the cylinder 345 is returned to a fuel tank (not shown) or the pump chamber 4 of the fuel injection pump 1 through a return passage 350. Also air which has been trapped in the second back-pressure chamber 342 is taken out through the return passage 350. The second back-pressure chamber 342 is closed by a cap 351 having the return passage 350 formed therein and retaining a spring 354. The cap 351 is inserted into a housing 343 and fixed thereto by a lock-nut 358. A cap stopper 358 is positioned in contact with a front surface 351*a* of the cap 351. The cap stopper 358 includes a passage 356 which is connected to the return passage 350 formed in the cap 351. A front surface 358*a* of the cap stopper 358 is arranged to be coaxial with a minor diameter portion 346*a* of the accumulate piston 346 and has a diameter $d_2$ which is substantially the same as the diameter $d_1$ of the minor diameter portion 346*a*. This front surface 358*a* acts to limit the movable distance of the pressure pin 347 to a predetermined movable distance $L_2$ which is slightly longer than the movable distance $L_1$ of the accumulate piston 354. A shim 360 for adjusting the urging force of the spring 354 is mounted on a bearing surface 358*b* of the cap stopper 358 for the purpose of urging the accumulate piston 346 with a predetermined urging force. In addition, a gasket 361 for maintaining an oil-tight state of the second back-pressure chamber 342 is disposed between the cap 351 and the housing 343.

On the other hand, the accumulate piston 346 is moved along an inner surface 345*a* of the cylinder 345. This cylinder 345 is connected to the pressurizing chamber 10 through a connection hole 347. An inner surface 348*b* of the end portion of the cylinder 345 adjacent to the connection hole 347 is formed in a funnel shape arranged to start from the connection hole 347 and have an outer periphery of a diameter larger than the diameter of the accumulate piston 354. A head portion 354*b* of the accumulate piston 354 has a tapered shape of an angle smaller than the angle of the funnel-shaped inner end surface 345 of the cylinder 345, while the end surface of the same is arranged to have a diameter larger than the diameter of the connection hole 347 of the cylinder 345. Therefore, the funnel-shaped inner end surface 348*b* of the cylinder 345 serves as a seat portion against which the edge of the head portion 346*b* of the accumulate piston 346 is brought into contact when the pressure of the fuel in the pressurizing chamber 10 is lowered. A gasket 361 is disposed on the end surface of the cylinder 345 for the purpose of assuring an oil tight state between the pilot injection device 320 and the pressuring chamber 10 of the fuel injection pump 1.

According to this structure, when a main injection fuel starts, the accumulate piston 346 comes into contact with the stopper 352 which prevents any further movement to the right as viewed in FIG. 15. However, the pressure pin 353 which is urged by the minor diameter portion 346*a* having the diameter $d_1$ continues its movement to the right as viewed in FIG. 15 against the urging force of the spring 354 due to the inertia thereof. When a rear side 353*d* of the pressure pin 353 contacts the front surface 358*a* of the cap stopper 358, the pressure pin 353 also stops its movement to the right. At this moment, the rear side 353*d* of the pressure pin 353 and the front surface 358*a* of the cap stopper 358 contact each other over the area of the front surface 358*a* having the diameter $d_2$. Furthermore, the front surface 358*a* and the minor diameter portion 343*a* of the accumulate piston 343 for applying the urging force to the pressure pin 353 are disposed coaxially. Therefore, even if a foreign matter in the fuel is disposed between the rear side 353*d* and the front surface 358*a* at the time of the above-described contact, causing the relationship between the actual $L_2$ and $L_1$ to become $L_2 < L_1$, the pressure pin 353 and the accumulate piston 343 can be prevented from a being subjected to any shearing force or a bending moment due to such shearing force. Therefore, when the pressure pin 353 and the cap stopper 358 contact each other, any force (lateral load) which can urge the accumulate piston 343 against the inner surface 345*a* of the cylinder 345 is not generated.

Figure 16:
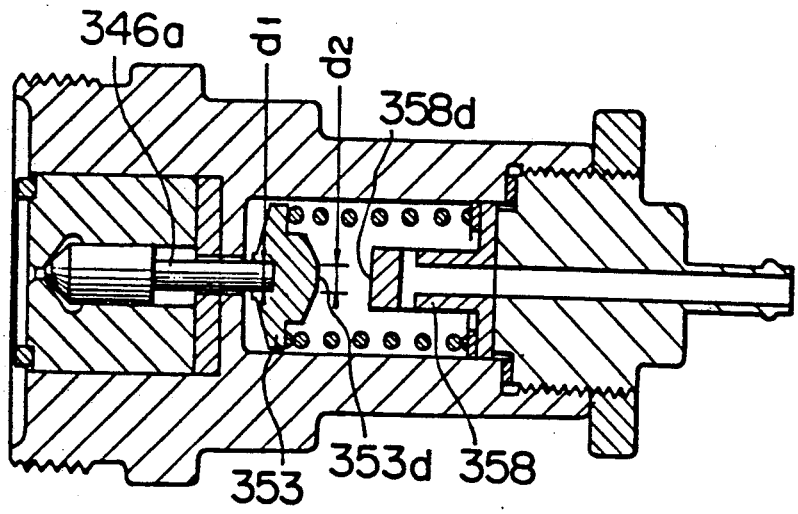
FIG. 16 illustrates a modification to the embodiment shown in FIG. 15.

According to this embodiment, the diameter $d_1$ of the minor portion 346*a* of the accumulate piston 346 and the diameter $d_2$ of the front surface 358*a* of the cap stopper 358 are arranged to be substantially the same. However, as shown in FIG. 16, an alternative structure may be employed to obtain the same effect, this structure being arranged such that a front surface 358*d* of the cap stopper 358 is arranged to have a relatively large diameter, the rear side 353*d* of the pressure pin 353 is formed to be a tapered shape, and the diameter of the rear end portion of the pressure pin 353 is arranged to be $d_2$ which is substantially the same as the diameter $d_1$ of the minor diameter portion 346*a*.

Figure 17:
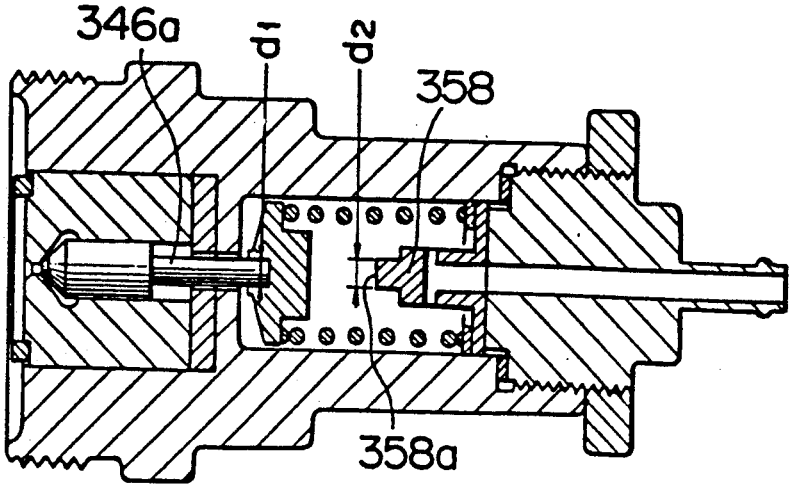
FIG. 17 illustrates another modification to the embodiment shown in FIG. 15.

The shape of the front surface 358*a* of the cap stopper 358 is not limited to the chamfered shape or the tapered shape provided that the diameter $d_2$ of the contact portion is substantially the same as $d_1$ of the minor diameter portion 346*a*. For example, as shown in FIG. 17, a structure can be employed in which the end surface is given by a cylindrical projection.

The other embodiment will be described with reference to FIG. 18.

Figure 18:
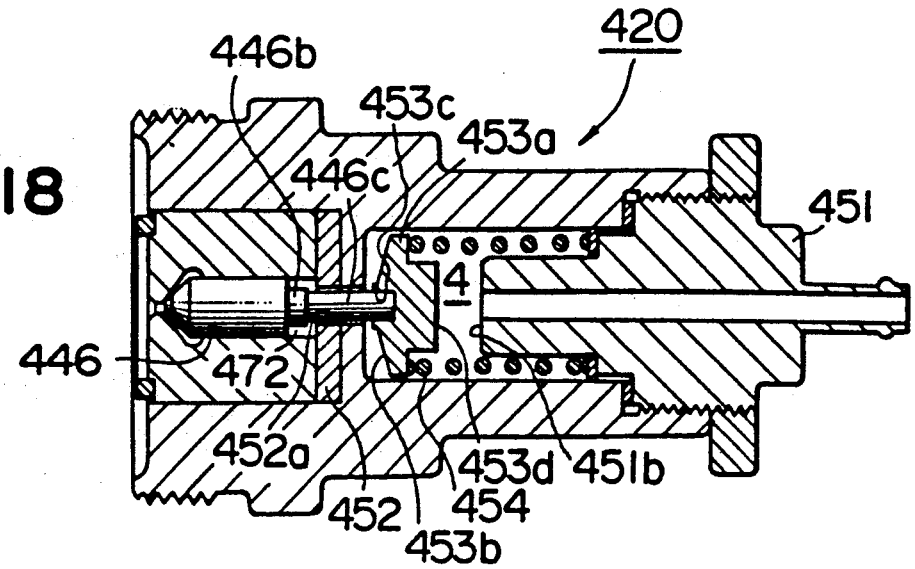
FIG. 18 is a sectional view which illustrates a still further embodiment of the present invention.
Figure 19:
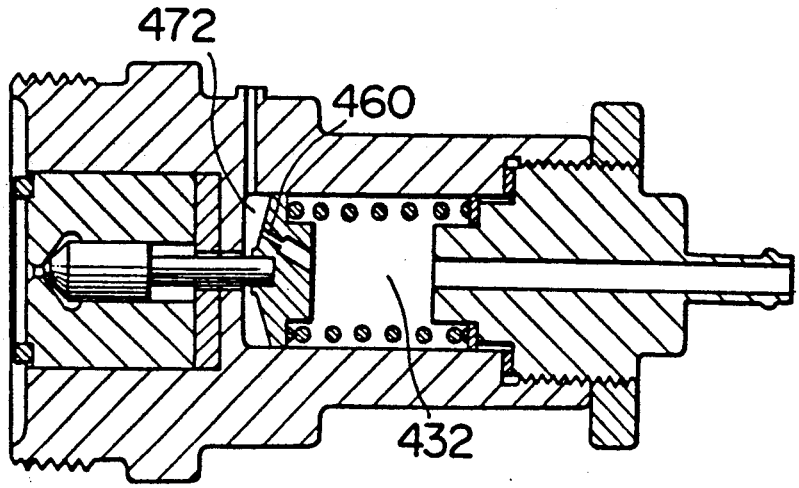
FIG. 19 illustrates a modification to the embodiment shown in FIG. 18.
Figure 20:
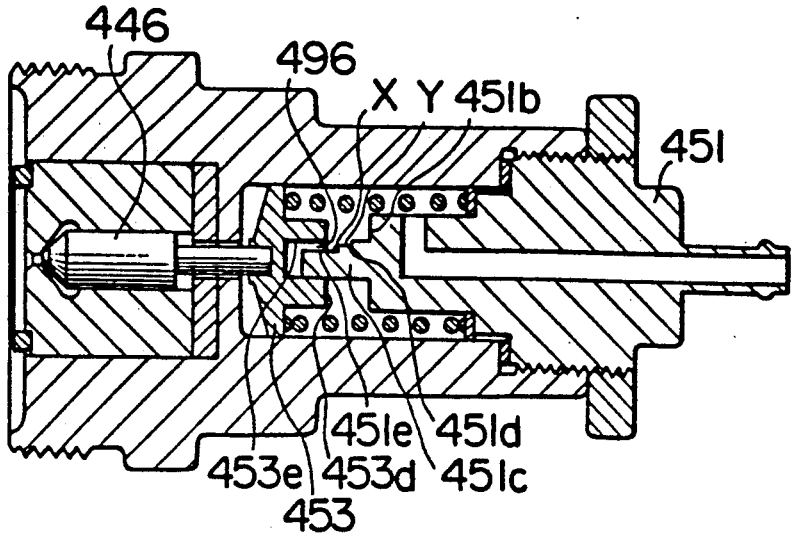
FIG. 20 illustrates another modification to the embodiment shown in FIG. 18.

Referring to FIG. 18, a through-hole 452*a* is formed in a stopper 452 and has a diameter smaller than that of a stepped journal portion 446*b* of the accumulate piston 446. The through-hole 452*a* is capable of receiving with a certain play a minor diameter portion 446*c* projecting rearwardly of the stepped journal portion 446*b*.

A pressure pin 453 comprises a body portion 453*a* to which an end portion of a spring 454 is seated and an integral head portion 453*b* having an outer diameter larger than that of the body portion 453*a* and having an end surface formed in a tapered shape. A bearing portion 453*c* which can receive, with a certain play, the small diameter portion 446*c* formed next to a stepped journal portion 446*b* of the accumulate piston 446 is formed in the head portion 453*b*. A first back-pressure chamber 472 is arranged to be of a structure which can provide an absorbing function when the flow area is reduced due to the contact between the stepped journal portion 446*b* formed next to the accumulate piston 446 and a through-hole 452*a* formed in the stopper 452.

According to this structure, when the accumulate piston 446 moves at a high speed upon receipt of the fuel pressure, the stepped journal portion 446*b* formed next to the rear end portion of the accumulate piston 446 comes closer to the surface of the stopper 452 as the distance of movement of the accumulate piston 446 is increased. As a result of this approach, the gap between the stepped journal portion 446*b* and the surface of the stopper 452 is reduced. Therefore, the flow area of fuel flowing out from the first back-pressure chamber 472 through a through-hole 452*a* is reduced. As a result of such increase in the flow resistance of the fuel, the first back-pressure chamber 472 serves as an absorber against the accumulate piston 446 which is being moved at a high speed. Therefore, the accumulate piston 446 is given a damping force, and the moving speed of it to the right is gradually lowered. As a result, the accumulate piston 446 and the stopper 452 can be brought into contact with each other without any excessive shock. Furthermore, since a pressure pin 453 which is arranged to move in synchronization with the accumulate piston 446 is not given any excessive inertia, its rear side 453*d* can be brought into contact with a front surface 451*b* of the cap 451 without any excessive shock. Furthermore, the spring 454 is protected from an excessive pressure from the pressure pin 453.

Alternatively, a further alternative structure may be employed which is arranged such that the first back-pressure chamber 472 and a second back-pressure chamber 432 are connected to each other by an orifice 460, and the passage through which the fuel passes from one of the two back-pressure chambers 472 and 423 is restricted when the pressure pin 453 which is arranged to move in synchronization with the accumulate piston 446 is moved, to thereby providing an absorbing mechanism.

In addition, a still further alternative structure may be employed which is arranged such that a hole 453*e* is formed in the rear side 453*d* of the pressure pin 453, and a front portion 451*c* having a stepped structure is formed in a head portion 451*b* of the cap 451. That is, the front portion 451*c* has a major-diameter stepped portion 451*d* having a surface Y formed by grinding only a part of the circular cross section of a front portion 451*c* which is disposed adjacent to a head portion 451*b* and a minor-diameter stepped portion 451*e* having a surface X formed by grinding a part of the circular cross section of the front portion 451*c* by a slightly large amount in order to be fitted into a hole 453*e* of the pressure pin 453. A gap 496 at the fitting portion is relatively large during the time when the hole 453 receives the small-diameter stepped portion 451*e* at the time of the movement of the pressure pin 453 which is arranged to move in synchronization with the accumulate piston 446. Therefore, the passage for the fuel flowing out of the hole 453*e* to the back-pressure chamber 432 is of relatively wide. However, when the major-diameter stepped portion 451*d* and the hole 453*e* of the pressure pin 453 are coupled to each other, the gap 496 formed therebetween becomes relatively small. Therefore, the flow of the fuel out of the hole 453*e* to the back-pressure chamber 432 is restricted, so that an absorbing function is effected.

What is claimed is:

1. A pilot injection device for a fuel injection pump, comprising:

means forming a cylinder connected to a pressurizing chamber of said fuel injection pump;

an accumulate piston slidably disposed in said cylinder and being movable in response to a rise in fuel pressure in said pressurizing chamber;

means defining therein a back-pressure chamber connected to said cylinder, filled with fuel therein and being capable of controlling the movement of said accumulate piston;

means for allowing air accumulated in said back pressure chamber to be removed, said allowing means comprising a through-hole connecting the interior of said back-pressure chamber to the outside thereof;

means for opening and closing said through-hole, said opening and closing means comprising a detachable screw; and a stopper connected to said detachable screw for determining the maximum movement of said accumulate piston.

2. A pilot injection device for a fuel injection pump, comprising:

means forming a cylinder connected to a pressurizing chamber of said fuel injection pump;

an accumulate piston slidably disposed in said cylinder and being movable in response to a rise in fuel pressure in said pressurizing chamber;

means defining therein a back-pressure chamber connected to said cylinder, filled with fuel therein and being capable of controlling the movement of said accumulate piston;

means for allowing air accumulated in said back-pressure chamber to be removed;

a pressure pin connected to said accumulate piston;

said cylinder accommodating a first stopper for limiting the movement of said accumulate piston and a second stopper for limiting the movement of said pressure pin; and the distance between said pressure pin and said second stopper being slightly greater than the distance between said accumulate piston and said first stopper.

3. A pilot injection device for a fuel injection pump, comprising:

means forming a cylinder connected to a pressurizing chamber of said fuel injection pump;

an accumulate piston slidably disposed in said cylinder and being movable in response to a rise in fuel pressure in said pressuring chamber;

means defining therein a back-pressure chamber connected to said cylinder, filled with fuel therein, and being capable of controlling the movement of said accumulate piston; and means for allowing air accumulated in said back-pressure chamber to be removed; wherein said cylinder accommodates a first stopper for restricting the movement of said accumulate piston and a second stopper for restricting a pressure pin connected to said accumulate piston, wherein a distance between said pressure pin and said second stopper is set to be slightly larger than the distance between said accumulate piston and said first stopper.

4. A pilot injection device for a fuel injection pump, comprising:

means forming a cylinder connected to a pressurizing chamber of said fuel injection pump;

an accumulate piston slidably disposed in said cylinder and being movable in response to a rise in the fuel pressure in said pressurizing chamber;

means defining therein a back-pressure chamber connected to said cylinder, filled with fuel therein and being capable of controlling the movement of said accumulate piston;

a pressure pin connected to said accumulate piston;

a first stopper defining a maximum stroke position of said accumulate piston;

a second stopper defining a maximum stroke position of said pressure pin;

means for allowing air accumulated in said back-pressure chamber to be removed therefrom, said allowing means comprising a through-hole which connects an inside of said back-pressure chamber to the outside thereof; and means for opening and closing said through-hole, said opening and closing means comprises a detachable screw, wherein said second stopper is secured to said screw.

5. A pilot injection device according to claim 3, wherein said allowing means comprises a through-hole which connects an inside of said back-pressure chamber to the outside thereof.

6. A pilot injection device according to claim 5, further including means for opening and closing said through-hole.

7. A pilot injection device according to claim 6, wherein said opening and closing means comprises detachable screw.

8. A pilot injection device according to claim 6, wherein said opening and closing means comprises a check valve openable by an external force.

9. A pilot injection device according to claim 6, wherein said opening and closing means comprises a blind cap detachable from outside.

10. A pilot injection device according to claim 3, wherein said cylinder forming means comprises a member detachably fastened to a high pressure resisting sealing member which is secured to said injection pump to keep said pressurizing chamber in sealed condition.

11. A pilot injection device according to claim 3, wherein said second stopper is formed in a hollow shape.

12. A pilot injection device according to claim 3, wherein a minimum diameter of said accumulate piston is smaller than a diameter of a surface of said second stopper at which said pressure pin contacts said second stopper.

13. A pilot injection device according to claim 3, further including means for restricting a flow of fuel generated due to the movement of said accumulate piston.

* * * * *